US006512896B2

(12) United States Patent
Asanuma et al.

(10) Patent No.: US 6,512,896 B2
(45) Date of Patent: Jan. 28, 2003

(54) IMAGE FORMING APPARATUS WITH DETACHABLE MOUNTING PROCESS CARTRIDGE

(75) Inventors: Masato Asanuma, Nara (JP); Kouichi Takenouchi, Tenri (JP); Hiroo Naoi, Nara (JP); Syouichi Fujita, Kashiba (JP); Hirofumi Sakita, Tenri (JP); Hideji Saiko, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/864,370

(22) Filed: May 25, 2001

(65) Prior Publication Data

US 2001/0055493 A1 Dec. 27, 2001

(30) Foreign Application Priority Data

May 26, 2000 (JP) ..... 2000-157088

(51) Int. Cl.[7] ..... G03G 15/00
(52) U.S. Cl. ..... 399/25; 399/26; 399/27
(58) Field of Search ..... 399/24, 25, 26, 399/27, 111

(56) References Cited

U.S. PATENT DOCUMENTS 5,051,778 A * 9/1991 Watanabe et al. ..... 399/25
5,572,292 A * 11/1996 Chatani et al. ..... 399/25
5,708,912 A * 1/1998 Lee ..... 399/24
RE35,751 E * 3/1998 Midgley ..... 399/25
5,822,646 A * 10/1998 Kinoshita et al. ..... 399/24

FOREIGN PATENT DOCUMENTS

JP A8185094 7/1996

* cited by examiner

*Primary Examiner*—Hoan Tran
(74) *Attorney, Agent, or Firm*—Birch, Stewart, Kolasch & Birch, LLP

(57) ABSTRACT

A device has a process cartridge that includes a main cartridge accommodating a photosensitive body and a toner cartridge for use in replenis'hing toner as a precondition, is to precisely judge the service life of a photosensitive body and replacement timing of a main cartridge. Whether a predetermined condition is satisfied or not is judged with reference to a recording sheets count value G, a total operation time Tt1 and a toner cartridge related operation time Tx of the photosensitive drum, and a toner replenishing time Ts. In cases where a predetermined condition is satisfied, a message is displayed to urge the user to replace the process cartridge or the toner cartridge. When the toner is used up, the recording operation is inhibited, and an instruction to replace the process cartridge or the toner cartridge is displayed. Consequently, it is possible to accurately replace the photosensitive drum and toner cartridge at their respective adequate replacement timings.

13 Claims, 7 Drawing Sheets

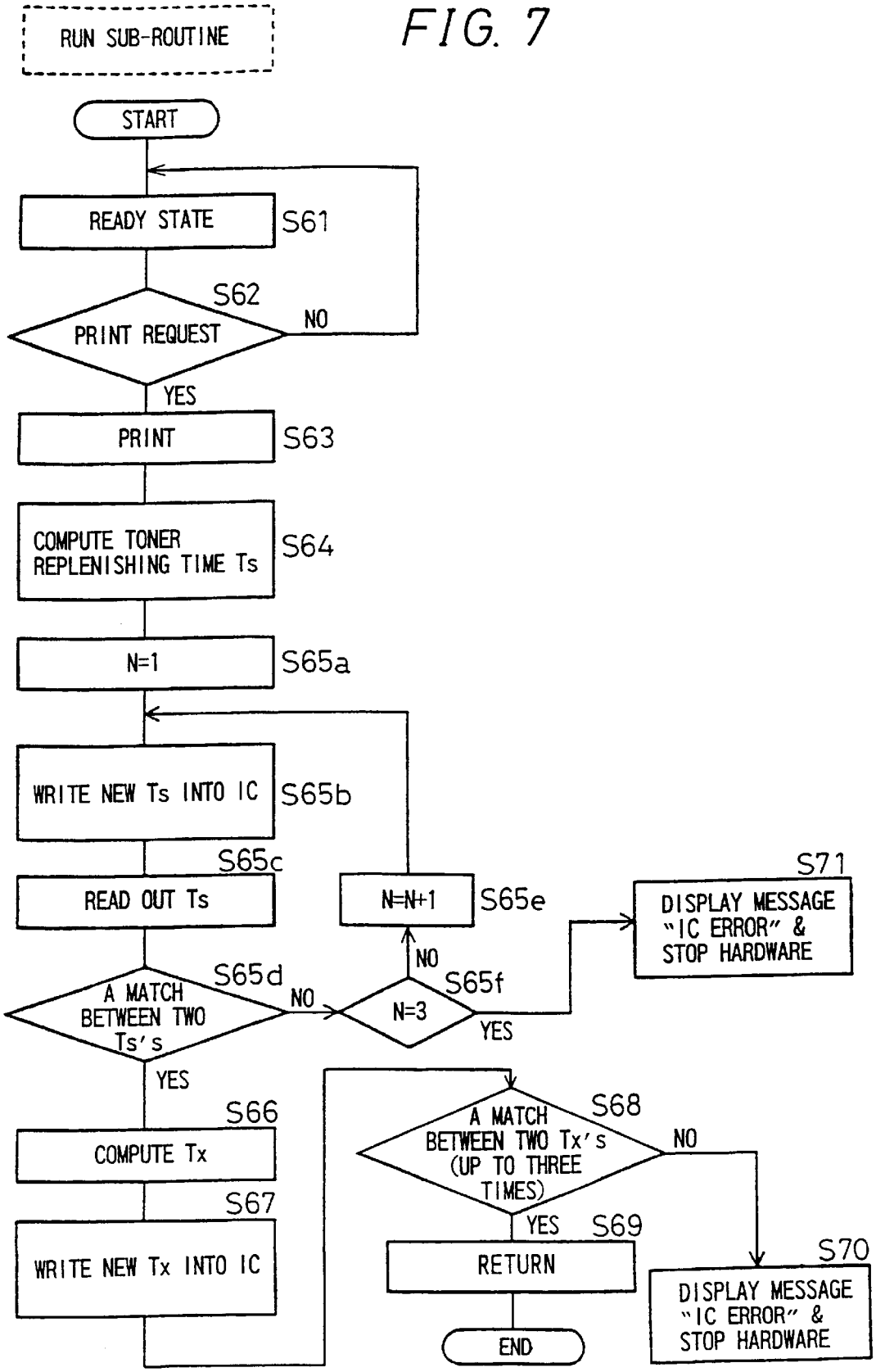
FIG. 7
RUN SUB-ROUTINE
START
READY STATE
S61
S62
PRINT REQUEST
NO
YES
PRINT
S63
COMPUTE TONER REPLENISHING TIME Ts
S64
N=1
S65a
WRITE NEW Ts INTO IC
S65b
S65c
READ OUT Ts
N=N+1
S65e
S71
DISPLAY MESSAGE "IC ERROR" & STOP HARDWARE
NO
S65d
A MATCH BETWEEN TWO Ts's
NO
S65f
N=3
YES
YES
S66
COMPUTE Tx
S68
A MATCH BETWEEN TWO Tx's (UP TO THREE TIMES)
NO
S67
WRITE NEW Tx INTO IC
YES
S69
RETURN
S70
DISPLAY MESSAGE "IC ERROR" & STOP HARDWARE
END

IMAGE FORMING APPARATUS WITH DETACHABLE MOUNTING PROCESS CARTRIDGE

BACKGROUND OF THE INVENTION

1. Field of the Invention

The present invention relates to an image forming apparatus, such as a printer or an electrophotographic copying machine, and more particularly to an image forming apparatus comprising a detachably mountable process cartridge that includes a main cartridge accommodating a photosensitive body and a toner cartridge for replenishing toner.

2. Description of the Related Art

As has been known, while an image forming apparatus repeats recording operation on recording sheets, toner is used up or a photosensitive drum wears out and deteriorates. When such an inconvenience occurs, it is necessary to replenish toner or replace the photosensitive drum. Also, a cleaning device needs to be replaced when it is filled with waste toner being removed from the surface of the photosensitive drum.

Conventionally, devices such as a photosensitive drum, a cleaning device and so on are normally replaced by a service person. Hence, a user's urgent demand cannot be met, which has been raising a problem that the service is less satisfactory.

For this reason, a process cartridge accommodating a photosensitive drum and peripheral mechanisms of the photosensitive drum has been employed and becoming increasingly popular in recent years. The process cartridge is detachably mounted to the image forming apparatus main body and can be replaced by a user, thereby facilitating the convenience of maintenance and improving serviceability.

One type of the process cartridge is arranged such that a cleaning device or a developing device is accommodated therein together with a photosensitive drum. Another type of the process cartridge is arranged such that at least one of a charging device, a developing device, or a cleaning device is accommodated therein together with a photosensitive drum.

However, because such a process cartridge puts an emphasis on easy maintenance, a large margin is provided concerning the lifetime of a photosensitive drum, a developing device and a cleaning device accommodated in the process cartridge, in order to ensure a reliable operation of the photosensitive drum and other devices until toner cartridge becomes empty. Thus, in this case, when a process cartridge is replaced at the time a toner cartridge has become empty, a still serviceable photosensitive drum and other devices are also removed, which has been resulting in wastes of these components.

Given such a background, there has been proposed a process cartridge arranged so as to be divided into two portions: a main cartridge accommodating a photosensitive drum and other devices, and a toner cartridge filled with toner. In this case, when the toner is used up, only the toner cartridge is to be replaced, and when deterioration occurs in the photosensitive drum or any other devices after using several toner cartridges, both of the toner cartridge and the main cartridge, that is, a whole process cartridge, is to be replaced.

According to such an arrangement, it is necessary to find the end of the service life of the photosensitive drum, with which several toner cartridges have been used. For example, there is a simple method, by which a main cartridge accommodating a photosensitive drum is to be replaced after replacing toner cartridges for a predetermined number of times.

In this method, however, the predetermined time cannot be selected without an assumption of a standard using condition, such as assuming an average print ratio of a document (ratio of printed area to overall area of a document) as approximately 5% in the case of an A4 size document and a print job of a relatively large number of sheets at a time. On the contrary, actual using conditions cannot be uniform and are diverse. A replacement timing of a toner cartridge or a main cartridge can vary depending on situations, and thus the method is not providing an actual replacement timing of the cartridges.

Examples of cases beyond the standard using condition are such as where a document having a relatively high print ratio is frequently recorded, or oppositely, where a document having a relatively low print ratio is recorded, where a continuous printing or intermittent printing operation is carried out, and so on. Thus, the above simple method cannot be the way to find an actual timing of replacement for a toner cartridge or a main cartridge used under these conditions. For example, in cases where a print operation with a low print ratio is performed most of the time, a film on the photosensitive drum accommodated in the main cartridge wares out to cause a poor image quality before the toner in the toner cartridge is used up.

Hence, there is a need for another method to precisely determine the end of the service life of a photosensitive drum accommodated in a main cartridge. For example, introduction of an optical sensor allows direct judgment of the end of the service life of a photosensitive drum. However, this method cannot be the best under the condition using a toner, because the optical sensor cannot be kept clean.

Instead, there has been proposed another method, by which the service life of a photosensitive drum is detected based on the number of recording sheets having undergone a recording operation or a total time of rotation of the photosensitive drum. For example, Japanese Unexamined Patent Publication JP-A 8-185094 (1996) describes an art of judging the end of the service life of the photosensitive drum based on a total number of rotations of the photosensitive drum.

However, the above method of using a total number of rotations of a photosensitive body, either, is not able to flexibly deal with the change in print ratio resulting in a gap with a standard using condition. Thus, the longer the service period of a photosensitive body, the larger becomes a judging error with respect to the service life of the photosensitive body.

Likewise, in cases where the service life of a photosensitive body is judged based on the number of recording sheets having undergone a recording operation, it is not able to flexibly deal with the change in print ratio resulting in a gap with a standard using condition. Thus, it has been impossible to accurately judge an actual replacement timing of the photosensitive body.

As above, none of the conventional methods is taking into consideration a change of printing condition such that goes out of an assumed standard, thereby resulting in a difficulty in accurately determining an actual replacement timing of a main cartridge accommodating a photosensitive body.

SUMMARY OF THE INVENTION

The invention is devised to solve the conventional problems as set forth for example above, and therefore, has an object to provide an image forming apparatus which applies a process cartridge that at least includes a main cartridge accommodating a photosensitive body and a toner cartridge for replenishing toner, and is capable of precisely judging the service life of the photosensitive body and the replacement timing of the main cartridge.

In order to solve the above problems, the invention provides an image forming apparatus comprising a process cartridge detachably mounted thereto, including a main cartridge accommodating a photosensitive body and a toner cartridge for replenishing toner; recording sheets counting means for counting a number of recording sheets having undergone a recording operation during a service period of the main cartridge; total operation time measuring means for measuring an operation time of a photosensitive body during the service period of the main cartridge as a total operation time; toner cartridge related operation time measuring means for measuring an operation time of the photosensitive body during a service period of the toner cartridge as a toner cartridge related operation time; toner replenishing time measuring means for measuring a time of replenishing toner from the toner cartridge as a toner replenishing time; and judging means for judging, based on the number of recording sheets counted by the recording sheets counting means, the total operation time measured by the total operation time measuring means, toner cartridge related operation time measured by the toner cartridge related operation time measuring means, and toner replenishing time measured by the toner replenishing time measuring means, at least one of (1) whether the main cartridge needs replacement, (2) whether the toner cartridge needs replacement, and (3) whether a recording operation is allowed or inhibited.

According to the invention, (1) whether the main cartridge needs replacement, (2) whether the toner cartridge needs replacement, and (3) whether a recording operation is allowed or inhibited, are judged based on the number of recording sheets having undergone a recording operation during the service period of the main cartridge, the total operation time of the photosensitive body during which the photosensitive body operates within the service period of the main cartridge, the toner cartridge related operation time of the photosensitive body during which the photosensitive body operates within the service period of the toner cartridge, and the toner replenishing time during which the toner is replenished from the toner cartridge. The toner replenishing time corresponds to a substantial quantity of replenished toner, and therefore, varies in accordance with a print ratio or a using condition, such as continuous or intermittent printing. Thus, it can be said that whether the main cartridge or toner cartridge needs replacement, and whether the recording operation is allowed or inhibited are judged based on the print ratio or a usage pattern, such as the continuous printing or intermittent printing, which makes an accurate judgment possible.

In the invention, it is preferable that the image forming apparatus further comprises invalidating means for invalidating, in cases where the toner cartridge is replaced with another toner cartridge though the toner cartridge is still able to replenish the toner, the toner cartridge related operation time measured by the toner cartridge related operation time measuring means and the toner replenishing time measured by the toner replenishing time measuring means.

According to the invention, when the toner cartridge is replaced inadequately, the toner cartridge related operation time and the toner replenishing time are to be invalidated. Hence, whether the main cartridge or the toner cartridge needs replacement and whether the recording operation is allowed or inhibited can be judged without an error.

Further in the invention, it is preferable that the image forming apparatus comprises displaying means for displaying various kinds of information and toner detecting means for detecting the toner cartridge has become empty, the judging means displays on the displaying means: (1) a message indicating a decrease of the toner when the toner replenishing time measured by the toner replenishing time measuring means has reached a predetermined time; (2) a message indicating that the toner cartridge will soon need replacement, upon judging that the toner cartridge needs replacement, and (3) a message indicating replacement of the toner cartridge when the toner detecting means detects the toner cartridge has become empty.

As above, by displaying up-to-date messages in response to conditions that keep on changing, an urgent job can be avoided, thereby allowing the user to be well-prepared for replacement of toner cartridge.

In the invention, it is also preferable that the toner cartridge related operation time measuring means measures the toner cartridge related operation time of the photosensitive body for a service period in each replacement of toner cartridge, and in replacement of toner cartridge, judging means takes an average of toner cartridge related operation times for all of replaced toner cartridges, and uses the average time as a toner cartridge related operation time.

In the invention, it is also preferable that the judging means initializes the toner cartridge related operation time when the main cartridge is replaced.

In the invention it is preferable that the judging means updates the average time to be used as a toner cartridge related operation time each time the toner cartridge is replaced since the image forming apparatus was activated for a first time.

By the use of an averaged toner cartridge related operation time taken among respective toner cartridges in this manner, it is possible to enhance the accuracy of judging based on the toner cartridge related operation time.

In the invention, it is also preferable that the image forming apparatus further comprises displaying means for displaying various kinds of information and toner detecting means for detecting the toner cartridge has become empty, and the judging means, upon detecting by the toner detecting means the toner cartridge has become empty, inhibits the recording operation and displays on the displaying means a message indicating replacement of the toner cartridge until the toner cartridge is replaced with another toner cartridge, regardless of a reset operation of the image forming apparatus.

In cases where it is detected in this manner that the toner cartridge has become empty, the recording operation is kept inhibited and a message to replace the toner cartridge is kept displayed until the empty toner cartridge is replaced with another toner cartridge regardless of whether or not a reset operation of the image forming apparatus is triggered. Hence, the operation of toner replenishing from an empty toner cartridge does not occur, and thereby idle rotation of a photosensitive body is prevented. Consequently, a waste operation can be eliminated and the service life of the photosensitive body can be extended.

In the invention, it is also preferable that the image forming apparatus further comprises displaying means for displaying various kinds of information and toner detecting means for detecting the toner cartridge has become empty, and the judging means displays on the displaying means: (1) a message indicating a decrease of the toner when the toner replenishing time measured by the toner replenishing time measuring means has reached a predetermined time, and (2) a message indicating that the main cartridge will soon need replacement upon judging that the main cartridge needs replacement, while allowing a recording operation to continue until either the toner detecting means detects that the toner cartridge has become empty or the total operation time measured by the total operation time measuring means reaches a predetermined time.

In the invention, it is also preferable that the image forming apparatus further comprises: displaying means for displaying various kinds of information; and toner detecting means for detecting the toner cartridge has become empty, and the judging means displays on the displaying means: (1) a message indicating a decrease of the toner when the toner replenishing time measured by the toner replenishing time measuring means has reached a predetermined time; and (2) a message indicating that the main cartridge will soon need replacement based on a using condition in accordance with the number of replaced toner cartridges, while allowing a recording operation to continue until the time either the toner detecting means detects the toner cartridge has become empty or the total operation time measured by the total operation time measuring means has reached a predetermined time.

As above, by displaying up-to-date messages in response to conditions that keep on changing, an urgent job can be avoided, thereby allowing the user to be well-prepared for replacement of toner cartridge. In addition, the recording operation is allowed to continue for a while.

In the invention, it is also preferable that the image forming apparatus further comprises displaying means for displaying various kinds of information, and the judging means inhibits a recording operation and displays on the displaying means a message indicating replacement of the main cartridge and the toner cartridge until the main cartridge and the toner cartridge are mounted regardless of a reset operation of the image forming apparatus.

As above, the recording operation is kept inhibited and a message to replace the toner cartridge is kept displayed until the empty toner cartridge is replaced with another toner cartridge without being affected by a reset operation of the image forming apparatus. Hence, an idle rotation of a photosensitive body is prevented. Consequently, a waste operation can be eliminated and the service life of the photosensitive body can be extended.

The invention also provides an image forming apparatus comprising a process cartridge detachably mounted thereto, including a main cartridge accommodating a photosensitive body and a toner cartridge for replenishing toner; recording sheets counting means for counting a number of recording sheets having undergone a recording operation during a service period of the main cartridge; toner remaining quantity detecting means for detecting a quantity of remaining toner inside the toner cartridge; and judging means for judging whether the main cartridge needs replacement based on the number of recording sheets counted by the recording sheets counting means and a quantity of the remaining toner detected by the toner remaining quantity detecting means.

According to the invention arranged in this manner, whether a main cartridge needs replacement is judged based on the number of recording sheets having undergone a recording operation during the service period of the main cartridge and a quantity of the remaining toner inside the toner cartridge. A quantity of the remaining toner corresponds to a substantial quantity of replenished toner, and therefore, changes in accordance with the print ratio or a using condition, such as continuous or intermittent printing. Thus, it can be said that whether the main cartridge needs replacement is judged based on an actual using condition, which makes an accurate judgment possible.

The invention also provides an image forming apparatus comprising a process cartridge detachably mounted thereto, including a main cartridge accommodating a photosensitive body and a toner cartridge for replenishing toner; total operation time measuring means for measuring a time during which the photosensitive body operates within a service period of the main cartridge as a total operation time; toner remaining quantity detecting means for detecting a quantity of remaining toner inside the toner cartridge; and judging means for judging whether the main cartridge needs replacement based on the total operation time measured by the total operation time measuring means and a quantity of the remaining toner detected by the toner remaining quantity detecting means.

According to the invention arranged in this manner, whether a main cartridge needs replacement is judged based on the total operation time of a photosensitive body during the service period of the main cartridge accommodating the photosensitive body and a quantity of the remaining toner inside the toner cartridge. A quantity of the remaining toner corresponds to a substantial quantity of replenished toner, and therefore, changes in accordance with the print ratio or a using condition, such as continuous or intermittent printing. Thus, it can be said that whether the main cartridge needs replacement is judged based on an actual using condition.

Further, the invention provides an image forming apparatus comprising a process cartridge detachably mounted thereto, including a main cartridge accommodating a photosensitive body and a toner cartridge for replenishing toner; total operation time measuring means for measuring a time during which the photosensitive body operates within a service period of the main cartridge as a total operation time; toner cartridge related operation time measuring means for measuring a time during which the photosensitive body operates within a service period of the toner cartridge as a toner cartridge related operation time; toner remaining quantity detecting means for detecting a quantity of remaining toner inside the toner cartridge; and judging means for judging whether the main cartridge needs replacement based on the total operation time measured by the total operation time measuring means, the toner cartridge related operation time measured by the toner cartridge related operation time measuring means, and a quantity of the remaining toner detected by the toner remaining quantity detecting means.

According to the invention, whether a main cartridge needs replacement is judged based on the total operation time of a photosensitive body during the service period of the main cartridge accommodating the photosensitive body, the toner cartridge related operation time of the photosensitive body during the service period of the toner cartridge, and a quantity of the remaining toner inside the toner cartridge. A quantity of the remaining toner corresponds to a substantial quantity of replenished toner, and therefore, changes in accordance with the print ratio or a using condition, such as continuous or intermittent printing. Thus, it can be said that whether the main cartridge needs replacement is judged based on an actual using condition.

BRIEF DESCRIPTION OF THE DRAWINGS

Other and further objects, features, and advantages of the invention will be more explicit from the following detailed description taken with reference to the drawings wherein:

FIG. 7 is a flowchart detailing a sub-routine of the control operations in FIGS. 4 and 5.

DETAILED DESCRIPTION OF THE PREFERRED EMBODIMENTS

Figure 1:
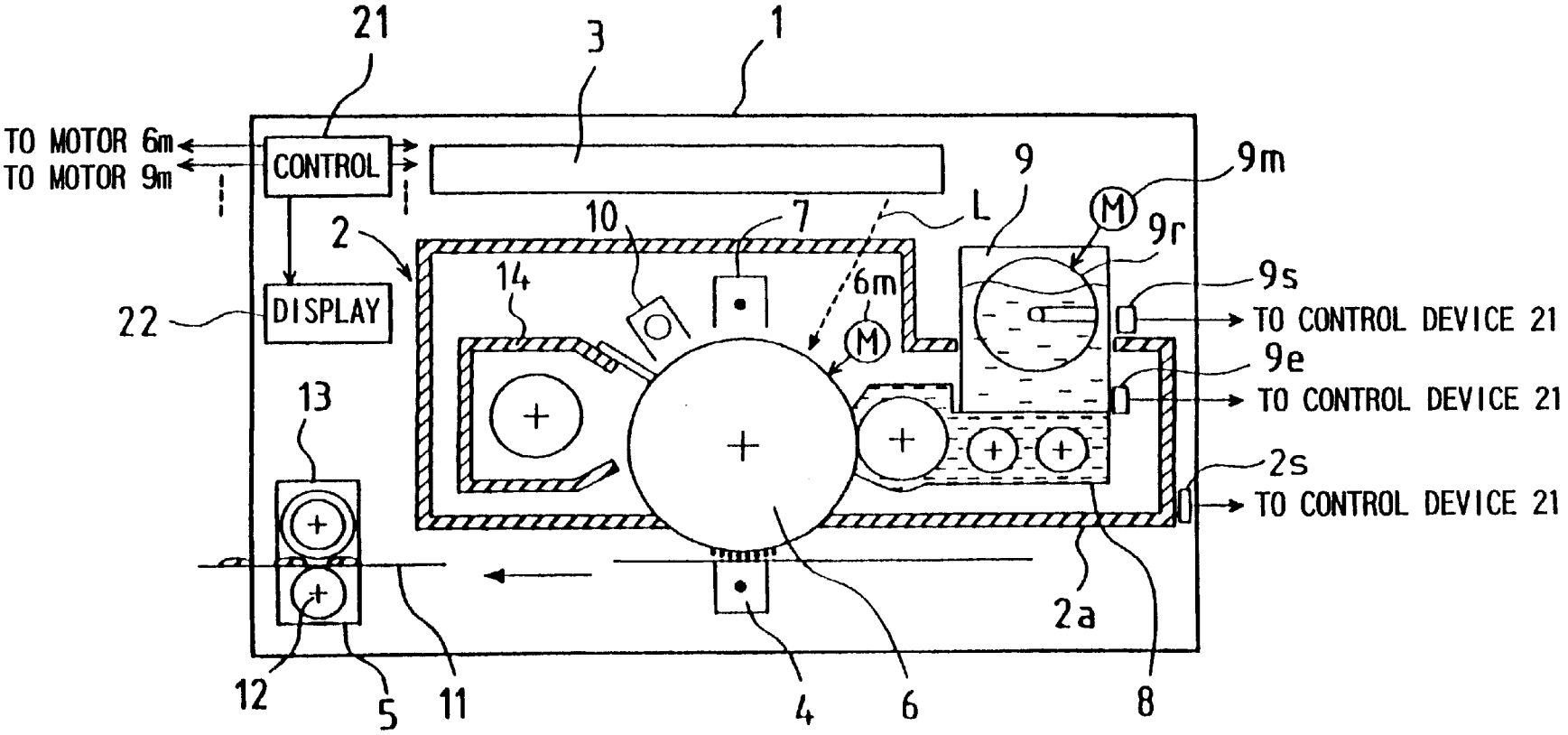
FIG. 1 is a side elevation schematically showing one embodiment of an image forming apparatus of the invention.

Now referring to the drawings, preferred embodiments of the invention are described below.

The following description will describe in detail one embodiment of an image forming apparatus of the invention.

The image forming apparatus of the present embodiment is provided with a detachably mountable process cartridge. The process cartridge includes a main cartridge and a toner cartridge detachably mounted to the main cartridge. The main cartridge accommodates at least a photosensitive drum, and the toner cartridge is at least filled with toner.

FIG. 1 is a view schematically showing an arrangement of the image forming apparatus of the embodiment. In the drawing, a photosensitive drum 6 is provided at or around the center of an apparatus main body 1, and surrounded by a charging device 7 for charging the photosensitive drum 6, a developing device 8 for developing an electrostatic latent image on the surface of the photosensitive drum 6 into a toner image by means of toner adhesion, a transferring device 4 for transferring the toner image formed on the surface of the photosensitive drum 6 onto a recording sheet being fed, a cleaner 14 for removing toner remaining on the surface of the photosensitive drum 6, and an erasing device 10 for erasing a residual potential on the surface of the photosensitive drum 6.

The photosensitive drum 6 is driven to rotate by a photosensitive drum motor 6*m*. An optical system 3 is placed above the photosensitive drum 6, and forms an electrostatic latent image on the surface of the photosensitive drum 6 by irradiating a laser beam L on the surface of the photosensitive drum 6 in accordance with an image signal. As the photosensitive drum 6 rotates, the electrostatic latent image on the surface thereof is developed into a toner image by the developing device 8, and the toner image is transferred onto a recording sheet 11 by the transferring device 4. A fusing device 5 is provided at the downstream of a transportation path of recording sheets, and sandwiches the recording sheet 11 between a pressing roller 12 and a heating roller 13 to fix the toner image onto the recording sheet 11 by means of heat fusing.

A toner cartridge 9 is mounted on the developing device 8. The toner cartridge 9 accommodates a toner replenishing roller 9*r*. The toner replenishing roller 9*r* is driven to rotate by a toner replenishing motor 9*m*, and toner filled in the toner cartridge 9 is replenished into the developing device 8 in association with the rotation of the toner replenishing roller 9*r*. Also, the toner cartridge 9 is provided with an empty sensor 9*e*. The empty sensor 9*e* judges whether the toner cartridge 9 is running out of toner.

A control device 21 controls the image forming apparatus comprehensively, and judges that the toner cartridge 9 has become empty based on a detection output from the empty sensor 9*e*, and judges whether a main cartridge 2*a* and the toner cartridge 9 are mounted to their respective positions based on detection outputs from their respective mounting sensors 2*s* and 9*s*. In addition, the control device 21 controls the driving of the photosensitive drum motor 6*m* and toner replenishing motor 9*m*. Further, the control device 21 displays information of various kinds on a display screen of a display device 22.

Figure 2:
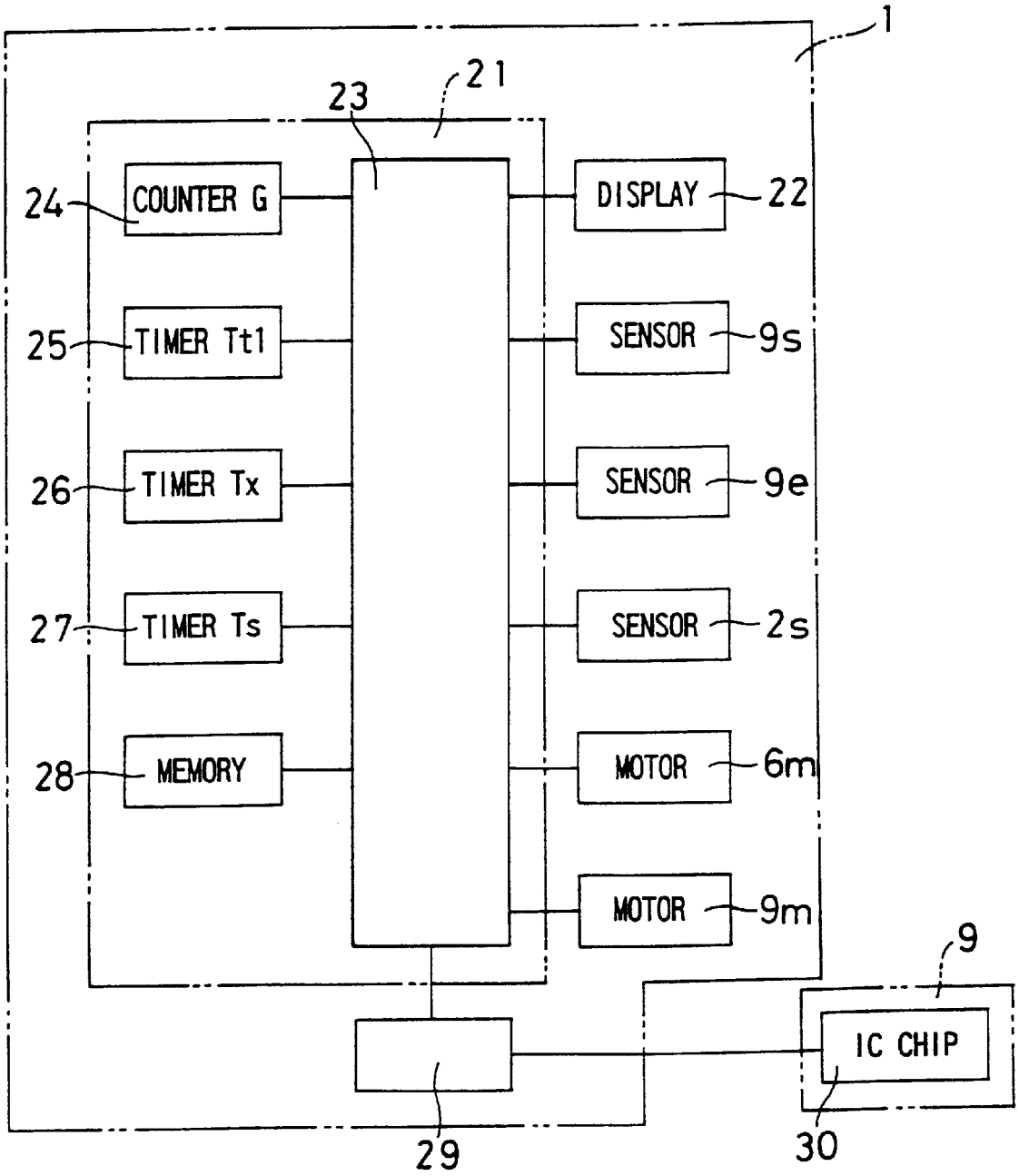
FIG. 2 is a block diagram schematically showing an electrical arrangement of the image forming apparatus of the invention.

FIG. 2 is a block diagram schematically showing an electrical arrangement of the image forming apparatus of the invention. FIG. 2 omits an arrangement related to the image forming process. The control device 21 includes a processing section 23, a counter 24, a plurality of timers 25 through 27, and a non-volatile memory 28. The processing section 23 is electrically connected to the counter 24, the plurality of timers 25 through 27, and non-volatile memory 28. Further, the processing section 23 is electrically connected to the display device 22, sensors 9*s*, 9*e* and 2*s*, and motors 6*m* and 9*m*.

The processing section 23 performs the comprehensive control over the image forming apparatus as has been discussed, and also carries out a series of jobs described below. The counter 24 counts the number (count value) G of recording sheets having undergone a printing operation during the service period of the main cartridge 2*a*. The timer 25 measures an operation time of the photosensitive drum 6 during the service period of the main cartridge 2*a* as total operation time Tt1. The timer 26 measures an operation time of the photosensitive drum 6 during the service period of the toner cartridge 9 as a toner cartridge related operation time Tx. The timer 27 measures a toner replenishing time Ts during which the toner is replenished from the toner cartridge 9. The non-volatile memory 28 stores the recording sheets count value G, total operation time Tt1, toner cartridge related operation time Tx, and toner replenishing time Ts. These contents G. Tt1, Tx, and Ts in the non-volatile memory 28 are maintained even after the occurrence of a power failure or initialization of the device main body 1.

The processing section 23 is furnished with a function to serve as a judging means for judging at least one of the followings: (1) whether the main cartridge 2*a* needs replacement; (2) whether the toner cartridge 9 needs replacement; and (3) whether a recording operation is allowed or inhibited, based on the count value G of the recording sheets counted by the counter 24, the total operation time Tt1 measured by the timer 25, the toner cartridge related operation time Tx measured by the timer 26, and the toner replenishing time Ts measured by the timer 27.

Figure 3:
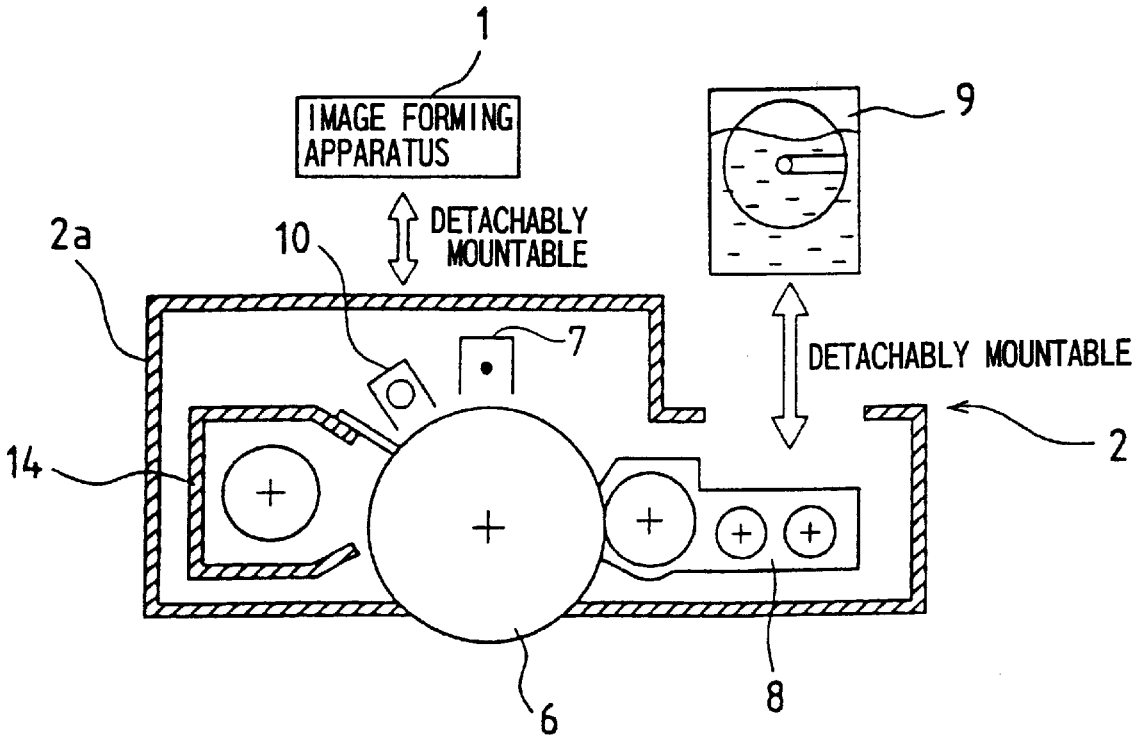
FIG. 3 is a side elevation schematically showing a process cartridge, a main cartridge, and a toner cartridge in accordance with the embodiment.

The main cartridge 2*a* accommodates the photosensitive drum 6, charging device 7, developing device 8, erasing device 10, and cleaner 14 shown in FIG. 3, and is detachably mounted to the apparatus main body 1. The toner cartridge 9 is detachably mounted to the developing device 8 in the main cartridge 2*a*. The process cartridge 2 is composed of the main cartridge 2*a* and the toner cartridge 9. Thus, removing the toner cartridge 9 from the process cartridge 2 leaves the main cartridge 2*a*.

In the image forming apparatus of the embodiment, the processing section 23 judges the replacement timing of the toner cartridge 9 and the replacement timing of the process cartridge 2 (main cartridge 2*a* and toner cartridge 9) separately, and displays the judging results on the display screen of the display device 22. Thus, from the judging results on the display screen, the user can know whether the toner cartridge 9 alone needs replacement or the process cartridge 2 as a whole needs replacement, and takes necessary actions promptly in a reliable manner.

This judging job uses the recording sheets count value G, total operation time Tt1, toner cartridge related operation time Tx, and toner replenishing time Ts, each of which will be described in the following descriptions.

(Recording sheets count value G)

When a new main cartridge 2*a* is mounted to the apparatus main body 1, the processing section 23 in the control device 21 judges the mounting of the main cartridge 2*a* based on the detection output from the mounting sensor 2*s*, and initializes the recording sheet count value G upon the judgment. Then, the processing section 23 increments the recording sheets count value G by one each time the image forming apparatus performs recording onto a recording sheet. Hence, the recording sheets count value G represents the number of recording sheets having undergone a recording operation during the service period of the main cartridge 2*a*.

The recording sheets count value G may be incremented each time a recording sheet is fed by a feeding device provided in the apparatus main body 1, or each time the printing for one recording sheet is performed.

(Total operation time Tt1)

The processing section 23 judges the mounting of a new main cartridge 2*a* based on the detection output from the mounting sensor 2*s*, and initializes the total operation time Tt1 upon the judgment. Then, the control devise increments the total operation time Tt1 on a second basis while the photosensitive drum 6 is rotated for recording by the image forming apparatus. Thus, the total operation time Tt1 represents an operation time of the photosensitive drum 6 during the service period of the main cartridge 2*a*.

(Toner cartridge related operation time Tx)

The processing section 23 judges the mounting of a new toner cartridge 9 based on the detection output from the mounting sensor 9*s*, and initializes the toner cartridge related operation time Tx upon judgment. Then, the processing section 23 increments the toner cartridge related operation time Tx on a second basis while the photosensitive drum 6 is rotated for recording by the image forming apparatus. Thus, the toner cartridge related operation time Tx represents an operation time of the photosensitive drum 6 during the service period of the toner cartridge 9.

Here, the toner cartridge 9 is provided with a storage means (IC chip: Integrated Circuit chip) 30, and the apparatus main body 1 is provided with a reading/writing means 29 electrically connected to the processing section 23, so that the toner cartridge related operation time Tx is written into the IC chip 30 in the toner cartridge 9 by the reading/writing means 29 in the apparatus main body 1 whenever the toner cartridge is mounted. In cases where there is a discrepancy between the toner cartridge related operation time Tx indicated in the control device 21 and the toner cartridge related operation time Tx written in the IC chip 30 in the toner cartridge 9, the processing section 23 invalidates the toner cartridge related operation time Tx for both. Consequently, even when the toner cartridge 9 is replaced with another toner cartridge 9 before the toner filled therein is used up, the toner cartridge related operation time Tx measured thus far will not be carried over, thereby making it possible to initialize the toner cartridge related operation time Tx.

(Toner replenishing time Ts)

The processing section 23 judges the mounting of the toner cartridge 9 based on the detection output from the mounting sensor 9*s*, and initializes the toner replenishing time Ts upon judgment. Then, the processing section 23 increments the toner replenishing time Ts on a second basis while rotating the toner replenishing motor 9*m* so as to replenish the developing device 8 with the toner from the toner cartridge 9 by rotating the toner replenishing roller 9*r*. Thus, the toner replenishing time Ts represents the toner replenishing time during the service period of the toner cartridge 9, which corresponds to quantities of replenished toner and remaining toner.

The toner replenishing roller 9*r* does not have to be kept rotated while the photosensitive drum 6 is operating, and may be rotated only when the developing device 8 needs toner replenishment.

Also, as is the case of the toner cartridge related operation time Tx, it may be arranged such that the toner replenishing time Ts is written into the IC chip 30 provided in the toner cartridge 9 by the reading/writing means 29 provided in the apparatus main body 1 when the toner cartridge 9 is mounted, so that when there is a discrepancy between the toner replenishing time Ts indicated in the control section 21 and the toner replenishing time Ts written in the IC chip 30 in the toner cartridge 9, the processing section 23 invalidates the toner replenishing time Ts for both. Consequently, in cases where the toner cartridge 9 is replaced with another toner cartridge 9 before the toner in the toner cartridge 9 is used up, it is not necessary to continue measuring the toner replenishing time Ts.

The recording sheets count value G, total operation time Tt1, toner cartridge related operation time Tx, and toner replenishing time Ts are stored in the non-volatile memory 28 in the control device 21, and maintained even after the occurrence of a power failure or initialization of the apparatus main body 1. Also, when the user operates the operating panel (not shown) of the apparatus main body 1 and inputs a display command, the processing section 23 displays the recording sheets count value G, total operation time Tt1, toner cartridge related operation time Tx, and toner replenishing time Ts on the display screen of the display device 22.

Next, the following description will describe judging conditions for the replacement timing of the toner cartridge 9 and the replacement timing of the process cartridge 2.

(Replacement timing of the toner cartridge 9)

When either of the following Conditions (1) and (2) is satisfied, the toner cartridge 9 is in replacement timing.

Condition (1)

An alarm is emitted for a quantity of remaining toner during the service period of a first toner cartridge 9, and G<60K and Tx<T2. More specifically, when an alarm is emitted for a quantity of remaining toner during the service period of a first toner cartridge 9, the recording sheets count value G during the service period of the main cartridge 2*a* is less than a preset value of 60K (G<60K) and the toner cartridge related operation time Tx of the photosensitive drum 6 during the service time of the first toner cartridge 9 has not reached a preset time T2 (Tx<T2), where K=1000 and T2=115K(seconds), and hence G<60000 and T2=115000.

Condition (2)

An alarm is emitted for a quantity of remaining toner during the service period of a replaced second toner cartridge 9 or thereafter, and G<60K and (T1−Tt1)≧0.7×Tx'. More specifically, when an alarm is emitted for a quantity of remaining toner during the service period of the replaced second toner cartridge 9 or thereafter, the recording sheets count value G during the service period of the main cartridge 2*a* is less than a preset value of 60K (G<60K), and a predetermined relationship ((T1−Tt1)≧0.7×Tx') is established among an average operation time Tx' determined by averaging the toner cartridge related operation times Tx of a plurality of toner cartridges 9, the total operation time Tt1, and a certain serviceable time T1 of the photosensitive drum 6. As long as the predetermined relationship is established, it is assumed that the total operation time Tt1 has not exceeded the serviceable time T1 of the photosensitive drum 6 when the remaining toner in the toner cartridge 9 is used up. Here, T1=164k, that is, T1=164000.

When either of the above Conditions, (1) or (2), is satisfied, the processing section 23 displays a message on the display screen of the display device 22 to let the user know that the toner cartridge 9 will need replacement soon and urge the user to prepare a spare toner cartridge 9. Also, the processing section 23 confirms the presence of the toner in the toner cartridge 9 based on the detection output from the empty sensor 9*e* in the toner cartridge 9, and maintains the state such that allows recording onto recording sheets by the image forming apparatus.

Then, subsequent recording onto recording sheets are carried on, as a result of which the toner in the toner cartridge 9 is used up, whereupon the processing section 23 judges the absence of toner based on the detection output from the empty sensor 9*e* and inhibits recording onto recording sheets by the image forming apparatus. Meanwhile, the processing section 23 displays an instruction to replace the toner cartridge 9 on the display screen of the display device 22. The processing section 23 of the control device 21 judges a replacement of the toner cartridge 9 based on the detection output from the mounting sensor 9*s*. The processing section 23 maintains the display of inhibition of recording onto recording sheets and keeps displaying the instruction to replace the toner cartridge 9 until the toner cartridge 9 is replaced without being affected by any operations such as a resetting operation of the image forming apparatus, for example, the image forming apparatus is turned off and subsequently on again, or a reset switch is activated due to the movement of the front door of the image forming apparatus.

(Replacement timing of the process cartridge 2)

When any one of following Conditions (3), (4), and (5) is satisfied, a process cartridge 2 is in replacement timing.

(Condition 3)

An alarm is emitted for a quantity of remaining toner during the service period of a toner cartridge 9, and G≧60K. More specifically, when an alarm is emitted for a quantity of remaining toner during the service period of the toner cartridge 9, the recording sheets count value G during the service period of the main cartridge 2*a* is equal to or greater than a preset value of 60K (G≧60K), where K=1000 and hence G≧60000.

Condition (4)

An alarm is emitted for a quantity of remaining toner during the service period of a first toner cartridge 9, and Tt1>T2 (=0.7×T1). More specifically, when an alarm is emitted for a quantity of remaining toner during the service period of the first toner cartridge 9, the total operation time Tt1 exceeds a predetermined time T2. Here, T2=115K (seconds), that is, T2=115000.

Condition (5)

An alarm is emitted for a quantity of remaining toner during the service period of a replaced second toner cartridge 9 or thereafter, and (T1−Tt1)<0.7×Tx'. More specifically, when an alarm is emitted for a quantity of remaining toner during the service period of a replaced second toner cartridge 9 or thereafter, a predetermined relationship ((T1−Tt1)<0.7×Tx') is established among an average operation time Tx' determined by averaging the toner cartridge related operation times Tx of a plurality of toner cartridges 9, the total operation time Tt1, and a predetermined time T1. In cases where the predetermined relationship is satisfied, it is expected that the total operation time Tt1 reaches or is almost reaching the serviceable time T1 of the photosensitive drum 6 when the remaining toner in the toner cartridge 9 is used up. Here, T1=164k, that is, T1=164000.

When any one of the above conditions (3), (4) and (5) is satisfied, the processing section 23 displays a message on the display screen of the display device 22 to let the user know that the main cartridge 2*a* and the toner cartridge 9 will need replacement soon and urge the user to prepare spare main cartridge 2*a* and toner cartridge 9. Thereafter, the processing section 23 maintains the state such that allows recording onto recording sheets by the image forming apparatus until the total operation time Tt1 exceeds a predetermined time T0 (=215K (seconds)) or the processing section 23 judges the absence of toner based on the detection output from the empty sensor 9*e* in the toner cartridge 9.

Here, the time T0 represents the service life of the photosensitive drum 6. When the total operation time Tt1 of the photosensitive drum 6 reaches the time T0, it is assumed that the film covering the surface of the photosensitive drum 6 wares out to the lower limit of the film thickness.

Upon judging either the total operation time Tt1 exceeding the time T0 or the absence of the toner based on the detection output from the empty sensor 9*e*, the processing section 23 inhibits recording onto recording sheets by the image forming apparatus, and displays an instruction to replace the main cartridge 2*a* and the toner cartridge 9 on the display screen of the display device 22. The processing section 23 judges the replacements of the cartridges 2*a* and 9 separately based on the detection outputs from their respective mounting sensors 2*s* and 9*s*, and maintains the display of inhibition of recording onto recording sheets and keeps displaying the instructions to replace the main cartridge 2*a* and the toner cartridge 9 until the main cartridge 2*a* and the toner cartridge 9 are replaced without being affected by any operations such as a resetting operation of the image forming apparatus. However, in cases where recording onto recording sheets is inhibited because the operation time Tt1 exceeds the time T0, the user can cancel the inhibition by operating the operating panel (not shown) of the apparatus main body 1 to resume recording onto recording sheets.

Display examples for each occasion and respective display timings related to the replacements of the toner cartridge 9 and main cartridge 2*a* are shown in Table 1 below.

TABLE 1

Figure 5:
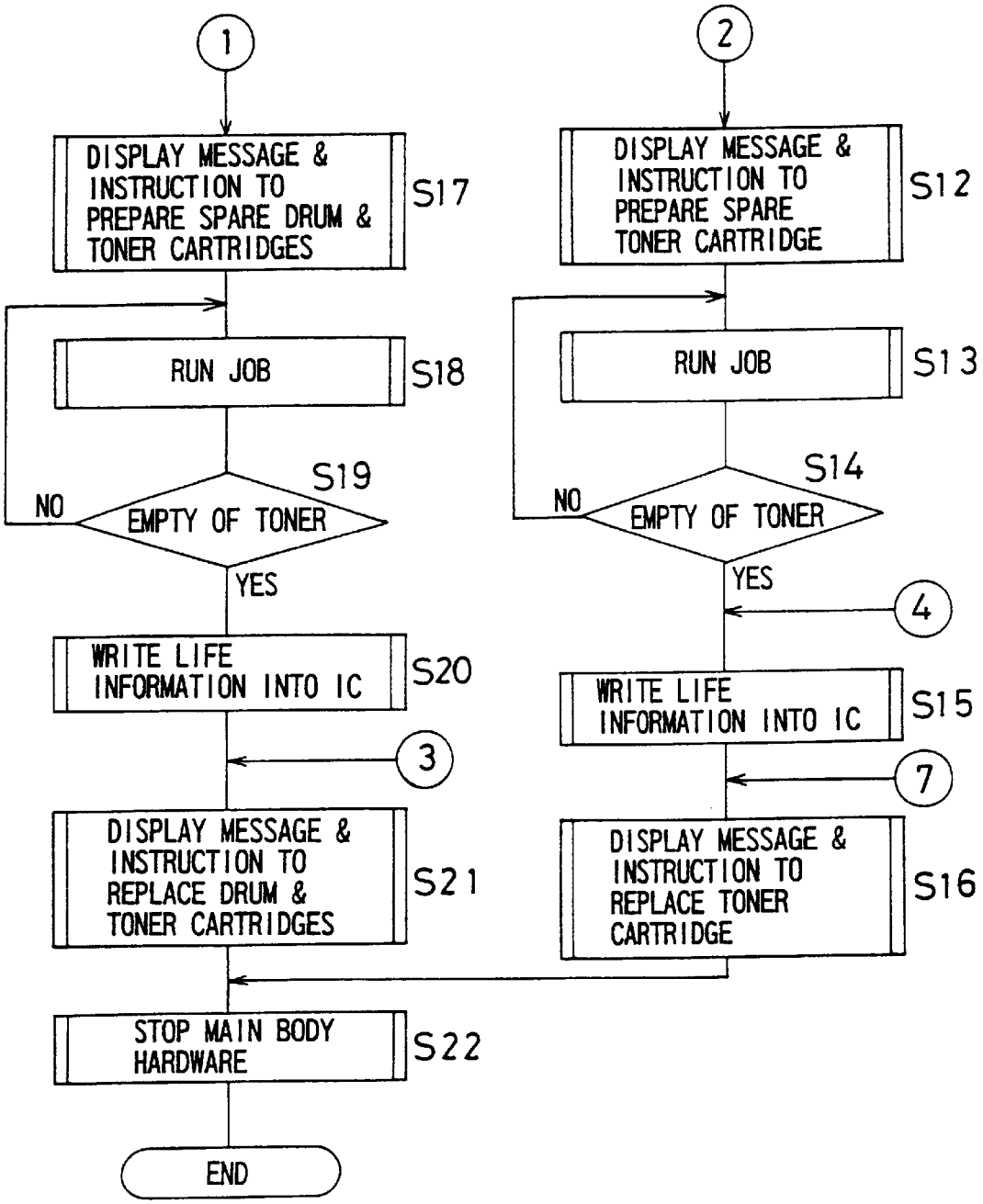
FIG. 5 shows a flowchart detailing a control operation following the flowchart in FIG. 4.

| Cartridge type | Display Timing | Message |
|---|---|---|
| Toner Cartridge | step S12 in FIG. 5 | Prepare new toner cartridge |
| | step S16 in FIG. 5 | Replace toner cartridge |
| | Initial detection on toner cartridge | No toner cartridge |
| | Initial detection on Toner cartridge | Wrong toner cartridge |

TABLE 1-continued

| Cartridge type | Display Timing | Message |
|---|---|---|
| | Print Count Security | Wrong toner cartridge |
| | Run a job | IC error |
| Process cartridge | step S17 in FIG. 5 | Prepare new process cartridge |
| | step S21 in FIG. 5 | Replace process cartridge |

The following description will describe, with reference to flowcharts in FIGS. 4 through 7, a judging procedure and a display procedure of the replacement timings of the toner cartridge 9 and process cartridge 2 in the image forming apparatus of the embodiment.

Figure 4:
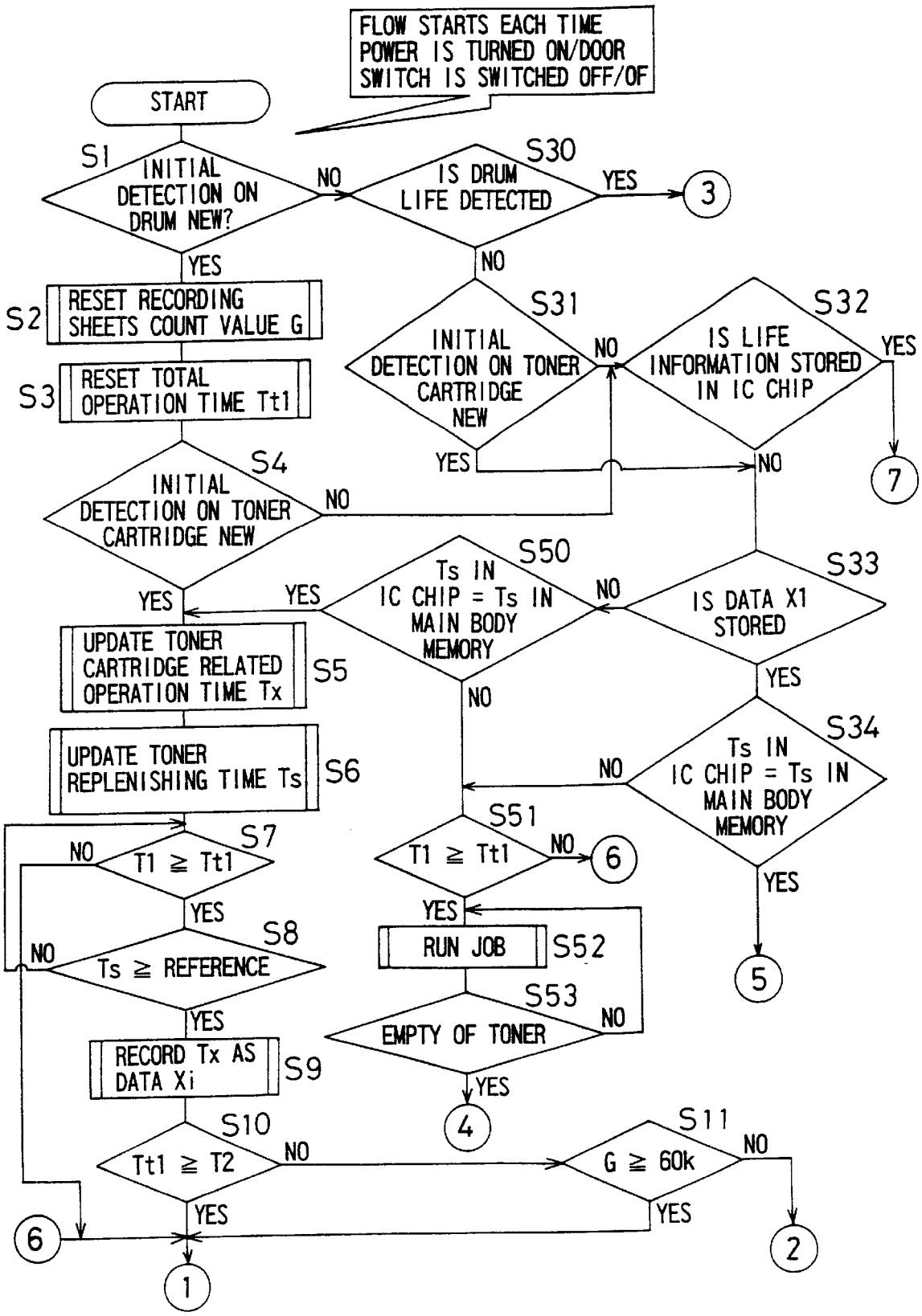
FIG. 4 shows a flowchart detailing a control operation by the image forming apparatus in accordance with the embodiment.

First, when the image forming apparatus is turned on, or reset by operation of a reset switch such as opening and closing the front door of the image forming apparatus, the processing section 23 in the control device 21 judges whether a new main cartridge 2*a* is mounted based on the detection output from the mounting sensor 2*s* (step S1 in FIG. 4). Then, upon judging a new main cartridge 2*a* mounted (Yes at step S1 in FIG. 4), the processing section 23 initializes the recording sheets count value G in the counter 24 and the total operation time Tt1 of the photosensitive drum 6 in the timer 25, while initializing the recording sheets count value G and total operation time Tt1 stored in the non-volatile memory 28 (steps S2 and S3 in FIG. 4).

Further, the processing section 23 judges whether a new toner cartridge 9 is mounted based on the detection output from the mounting sensor 9*s* (step S4 in FIG. 4). Then, upon judging a new toner cartridge 9 mounted (Yes at step 4 in FIG. 4), the processing section 23 initializes the toner cartridge related operation time Tx of the photosensitive drum 6 in the timer 26 and the toner replenishing time Ts of the toner cartridge 9 in the timer 27, while initializing the toner cartridge related operation time Tx and toner replenishing time Ts stored in the non-volatile memory 28 (steps S5 and S6 in FIG. 4).

Then, the processing section 23 judges whether the total operation time Tt1 of the photosensitive drum 6 is within the serviceable time T1 (=164K (seconds)) of the photosensitive drum 6 (step S7 in FIG. 4). Because the total operation time Tt1 has just been initialized, the processing section 23 judges that the total operation time Tt1 is within the time T1 (Yes at step S7 in FIG. 4). Then, the processing section 23 judges whether the toner replenishing time Ts of the toner cartridge 9 has reached the predetermined time, that is, whether a quantity of the remaining toner is low (step S8 in FIG. 4). Because the toner replenishing time Ts has just been initialized, the processing section 23 judges that a quantity of the remaining toner is not low (No at step S8 in FIG. 4). In this case, steps S7 and S8 are repeated.

While steps S7 and S8 are repeated, the processing section 23 stores the following into the non-volatile memory 28: (1) the recording sheets count value G to be updated each time recording onto a recording sheet is performed, (2) the total operation time Tt1 and the toner cartridge related operation time Tx to be updated in association with a rotation of the photosensitive drum 6, and (3) the toner replenishing time Ts of the toner cartridge 9 to be updated in association with a rotation of the toner replenishing roller 9*r*. Further, the toner cartridge related operation time Tx and toner replenishing time Ts are stored in the non-volatile memory 28 in the control section 21 to be updated respectively, and also written into the IC chip 30 in the toner cartridge 9 to be updated by means of the reading/writing mean 29 respectively.

When the total operation time Tt1 of the photosensitive drum 6 exceeds the serviceable time T1 of the photosensitive drum 6 while steps S7 and S8 are repeated (No at step S7 in FIG. 4), the processing section 23 proceeds to step 17 in FIG. 5, which will be described below.

Also, upon judging that the toner replenishing time Ts has reached the predetermined time and a quantity of the remaining toner becomes low (Yes at step S8 in FIG. 4), the processing section 23 stores the toner cartridge related operation time Tx of the photosensitive drum 6 into the non-volatile memory 28 as data X1 (step S9 in FIG. 4), after which the processing section 23 judges whether the total operation time Tt1 of the photosensitive drum 6 has reached or exceeds a predetermined time T2 (steps S10 in FIG. 4). Here, the time T2 is a value obtained by multiplying the serviceable time T1 of the photosensitive drum 6 by a factor of 0.7 (T2=T1×0.7=164K×0.7=115K (seconds)).

In cases where the total operation time Tt1 of the photosensitive drum 6 has not reached the time T2 (No at step 10 in FIG. 4), it is assumed that the photosensitive drum 6 can continue recording. In this case, the processing section 23 judges whether the recording sheets count value G has reached 60K (step S11 in FIG. 4). In cases where the recording sheets count value G is less than 60K (No at step S11 in FIG. 4), it is judged that the photosensitive drum 6 is still serviceable. In other words, in cases where the total operation time Tt1 of the photosensitive drum 6 has not reached the time T2, and the recording sheets count value G is less than 60K, it is judged that there is some time left before the service life of the photosensitive drum 6 expires. Then, the processing section 23 proceeds to step S12 in FIG. 5.

At this time, the processing section 23 has already judged that a quantity of the remaining toner is low during the service period of the first toner cartridge 9 (Yes at step 8 in FIG. 4), the total operation time Tt1 of the photosensitive drum 6 (total operation time Tt1=toner cartridge related operation time Tx during the service period of the first toner cartridge 9) has not reached the time T2 (No at step S10 in FIG. 4), and the recording sheets count value G is less than 60K (No at step S11 in FIG. 4), whereby Condition (1) is satisfied. Hence, at step S12 in FIG. 5, the processing section 23 displays a message on the display screen of the display device 22 to let the user know that the toner cartridge 9 will need replacement soon and urge the user to prepare a spare toner cartridge 9. Then, the processing section 23 maintains the state such that allows recording onto recording sheets by the image forming apparatus (step S13 in FIG. 5) until the judgment of absence of the toner based on the detection output from the empty sensor 9*e* in the toner cartridge 9 (step S14 in FIG. 5). Upon judging the absence of the toner based on the detection output from the empty sensor 9*e* in the toner cartridge 9 (Yes at step S14 in FIG. 5), the processing section 23 writes into the IC chip 30 that the service life of the toner cartridge 9 has expired by means of the reading/writing means 29 (step S15 in FIG. 5). Thereafter, the processing section 23 keeps displaying the instruction to replace the toner cartridge 9 and maintains the inhibition of recording onto recording sheets until the toner cartridge 9 is replaced without being affected by a resetting operation of the image processing apparatus (steps S16 and S22 in FIG. 5).

When the user replaces the toner cartridge 9 in accordance with the replacement instruction on display, the processing section 23 stops displaying the instruction and removes the inhibition of recording, and returns to step 1 in FIG. 4.

On the other hand, in cases where the total operation time Tt1 of the photosensitive drum 6 has reached or exceeds the time T2 (Yes at step S10 in FIG. 4), it is assumed that the service life of the photosensitive drum 6 is about to expire. Further, even if the total operation time Tt1 has not reached the time T2, when the recording sheets count value G is 60K or more (Yes at step S11 in FIG. 4), it is also assumed that the service life of the photosensitive drum 6 is about to expire. For example, in cases where a number of documents are printed in multiple copies frequently, the recording sheets count value G may reach or exceed 60K before the total operation time Tt1 reaches the time T2. In this case, too, the processing section 23 proceeds to step S17 in FIG. 5.

At this time, the processing section 23 has already judged that a quantity of the remaining toner is low (Yes at step S8 in FIG. 4), and either the total operation time Tt1 of the photosensitive drum 6 has reached or exceeds the time T2 (Yes at step S10 in FIG. 4) or the printing sheets count value G is 60K or more (Yes at step S11 in FIG. 4), whereby either Condition (3) or (4) is satisfied. Hence, at step S17 in FIG. 5, the processing section 23 displays a message on the display screen of the display device 22 to let the user know that the main cartridge 2*a* and the toner cartridge 9 will need replacement soon and urge the user to prepare spare main cartridge 2*a* and toner cartridge 9. Then, the processing section 23 maintains the condition such that allows the recording by the image forming apparatus (step S18 in FIG. 5) until the judgment of the absence of the toner based on the detection output from the empty sensor 9*e* in the toner cartridge 9 (step S19 in FIG. 5). Upon judging the absence of the toner (Yes at step S19 in FIG. 5), the processing section 23 writes into the IC chip 30 in the toner cartridge 9 that the service life of the toner cartridge 9 has expired by means of the reading/writing means 29 (step S20 in FIG. 5). Thereafter, the processing section 23 keeps displaying the instruction to replace the main cartridge 2*a* and the toner cartridge 9 and maintains inhibition of recording onto recording sheets until the main cartridge 2*a* and the toner cartridge 9 are replaced regardless of whether or not the reset operation of the image processing forming apparatus is triggered (steps S21 and S22 in FIG. 5).

When the user replaces the main cartridge 2*a* and the toner cartridge 9 in accordance with the replacement instruction on display, the processing section 23 stops displaying the instruction and removes the inhibition of recording, and returns to step 1 in FIG. 4.

On the other hand, when it is judged that the mounted main cartridge 2*a* is not a new one at step S1 in FIG. 4, the processing section 23 reads out the total operation time Tt1 of the photosensitive drum 6 from the non-volatile memory 28, the measured value of the respective photosensitive drum 6, and judges whether the total operation time Tt1 of the photosensitive drum 6 has reached or exceeds the time T0 (=215K (seconds)) (step S30 in FIG. 4). In cases where the total operation time Tt1 of the photosensitive drum 6 has reached or exceeds the time T0 (Yes at step S30 in FIG. 4), it is assumed that the service life of the photosensitive drum 6 has expired, and the processing section 23 proceeds to steps S21 and S22 in FIG. 5.

In addition, in cases where the total operation time Tt1 of the photosensitive drum 6 has not reached the time T0 (No at step S30 in FIG. 4), the processing section 23 judges whether a new toner cartridge 9 is mounted based on the detection output from the mounting sensor 9*s* (step S31 in FIG. 4). Upon judging that the mounted toner cartridge 9 is not a new one (No at step S31 in FIG. 4), the processing section 23 judges whether it is written in the IC chip 30 in the toner cartridge 9 that the service life of the toner cartridge 9 has expired (step S32 in FIG. 4). In cases where the expiration of the service life has been written (Yes at step S32 in FIG. 4), it is assumed that the toner cartridge 9 needs replacement, and the processing section 23 proceeds to steps S16 and S22 in FIG. 5.

On the other hand, in cases where the mounted toner cartridge 9 is judged new (Yes at step S31 in FIG. 4) or the expiration of the service life of the toner cartridge 9 has not been written (No at step S32 in FIG. 4), at step S9 in FIG. 4, the processing section 23 runs a job of storing the toner cartridge related operation time Tx of the photosensitive drum 6 as data Xi (i=1, 2, . . . ) at least once and judges whether the data X1 has been stored. In cases where the processing section 23 judges that the data X1 has been stored (Yes at step S33 in FIG. 4), the processing section 23 confirms a match between the toner replenishing time Ts of the toner cartridge 9 read out from the IC chip 30 in the toner cartridge 9 by means of the reading/writing means 29 and the toner replenishing time Ts of the toner cartridge 9 stored in the non-volatile memory 28 in the control device 21 (Yes at step S34 in FIG. 4), that is, the previously used toner cartridge 9 is continuously used. Then, the processing section 23 proceeds to step S35 in FIG. 6.

In cases where the data X1, . . . at steps 9 in FIG. 4 has not been stored (No at step S33 in FIG. 4), the processing section 23 confirms a match between the toner replenishing time Ts read out from the IC chip 30 in the toner cartridge 9 and the toner replenishing time Ts stored in the non-volatile memory 28 in the control device 21 (Yes at steps 50 in FIG. 4), after which the processing section 23 proceeds to step S5 in FIG. 4. For example, in cases where the reset operation of the image forming apparatus is triggered while the first toner cartridge 9 is in use, the processing section 23 proceeds to steps S5 and S6 from step S50.

In steps S5 and S6 in FIG. 4, the toner cartridge related operation time Tx of the photosensitive drum 6 is not reset, but updated to a value read out from the IC chip 30 in the toner cartridge 9 by means of the reading/writing means 29. Likewise, the toner replenishing time Ts of the toner cartridge 9 is not reset, but updated to a value read out from the IC chip 30 in the toner cartridge 9 by means of the reading/writing means 29. Then, the processing section 23 proceeds to step S7 in FIG. 4 and onwards.

Also, at steps S34 and S50 in FIG. 4, in cases where a discrepancy is judged between the toner replenishing time Ts read out from the IC chip 30 in the toner cartridge 9 by means of the reading/writing means 29 and the toner replenishing time Ts stored in the non-volatile memory 28 in the control device 21, it means that the previously used toner cartridge 9 is not continuously used. For example, in cases where the toner cartridge 9 is replaced with another half-used toner cartridge 9 while the power of the image forming apparatus is OFF, the toner replenishing time Ts for both has a discrepancy. In such a case, the processing section 23 deletes the toner replenishing time Ts and the toner cartridge related operation time Tx stored in the non-volatile memory 28 and indicated in the control section 21, while deleting the toner replenishing time Ts and toner cartridge related operation time Tx stored in the IC chip 30 in the toner cartridge 9. Consequently, it is possible to prevent control based on inaccurate toner replenishing time Ts and toner cartridge related operation time Tx.

Thereafter, the processing section 23 judges whether the total operation time Tt1 of the photosensitive drum 6 is within the serviceable time T1 of the photosensitive drum 6 (step S51). Then, in cases where the total operation time Tt1 is not within the time T1 (No at step S51), the processing section 23 proceeds to step S17 in FIG. 5, and displays the instruction to replace the main cartridge 2*a* and the toner cartridge 9 after the toner is used up. In cases where the total operation time Tt1 is within the time T1 (Yes at step S51), the processing section 23 maintains the state such that allows recording by the image forming apparatus (step S52 in FIG. 4) until judging absence of toner based on the detection output from the empty sensor 9*e* in the toner cartridge 9 (step S53 in FIG. 4). Then, the processing section 23 proceeds to step S15 in FIG. 5.

Figure 6:
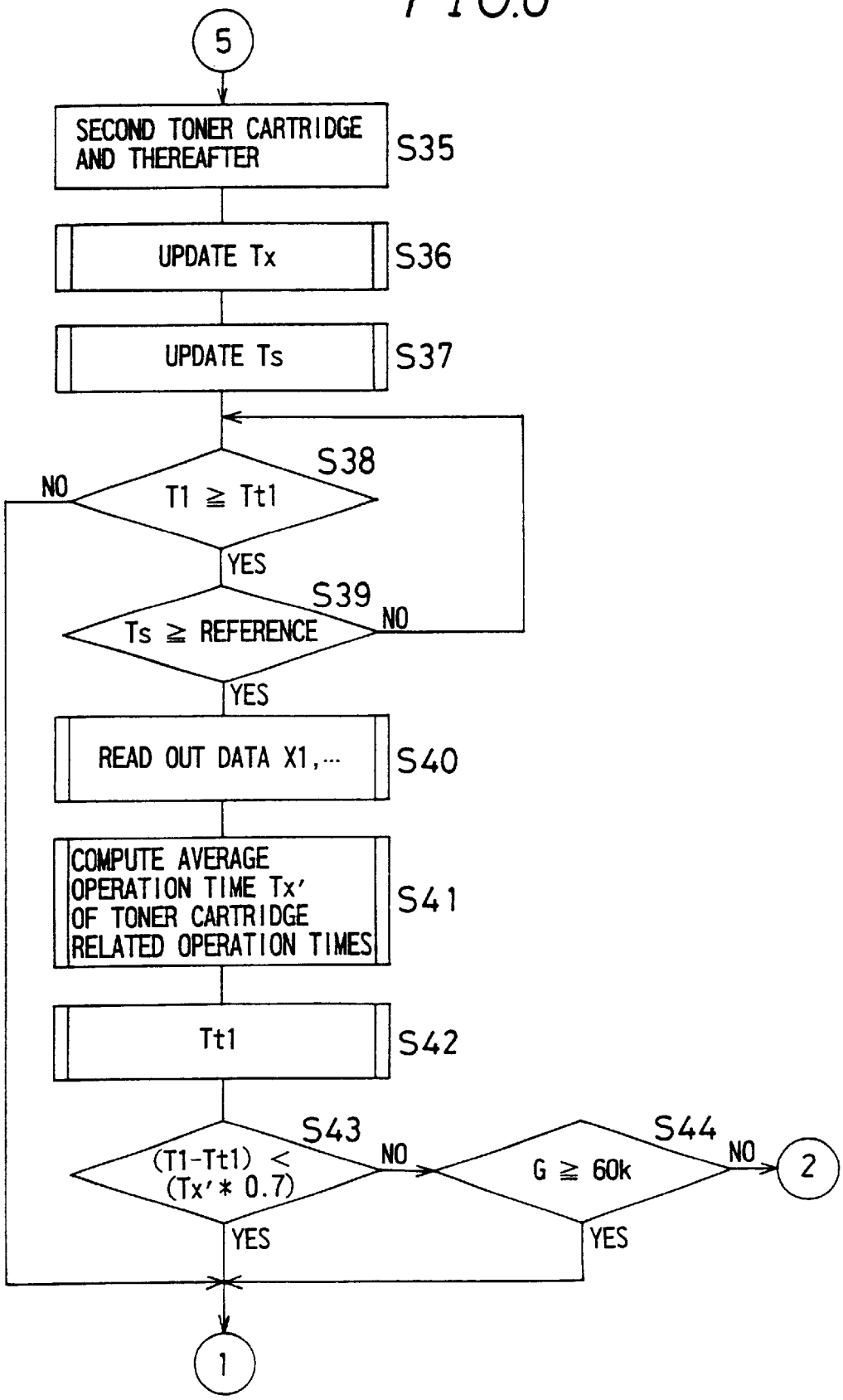
FIG. 6 shows a flow detailing another control operation following the flowchart in FIG. 4.

Then, in cases where the data X1, . . . at step 9 in FIG. 4 has been stored as discussed above (Yes at step S33 in FIG. 4), and one of the previously used toner cartridges 9 is continuously used (Yes at step S34 in FIG. 4), the processing section 23 proceeds to step S35 in FIG. 6. This case means that two or more toner cartridges 9 have been replaced.

Here, the processing section 23 updates the toner cartridge related operation time Tx of the photosensitive drum 6 to the value read out from the IC chip 30 in the toner cartridge 9 (step S36 in FIG. 6), and the toner replenishing time Ts of the toner cartridge 9 to the value read out from the IC chip 30 in the toner cartridge 9 (step S37 in FIG. 6). Then, the processing section 23 judges whether the total operation time Tt1 of the photosensitive drum 6 is within the serviceable time T1 (step S38 in FIG. 6), and in cases where the total operation time Tt1 is not within the time T1 (No at step S38 in FIG. 6), it means that the service life of the photosensitive drum 6 is about to expire. Hence, the processing section 23 proceeds to step S17 in FIG. 5. In cast that the total operation time Tt1 is within the time T1 (Yes at step S38 in FIG. 6), it is assumed that there is some time left before the service life of the photosensitive drum 6 expires. Thus, the processing section 23 judges whether the toner replenishing time Ts of the toner cartridge 9 has reached the predetermined time, that is, whether a quantity of the remaining toner is low (steps S39 in FIG. 6), and repeats steps S38 and S39 until the judgment of a quantity of the remaining toner becomes low.

Upon judging that the toner replenishing time Ts has reached the predetermined time and a quantity of the remaining toner becomes low while recording onto recording sheets is performed repetitively by repeating steps S38 and S39 (Yes at step S39 in FIG. 6), the processing section 23 stores the toner cartridge related operation time Tx of the photosensitive drum 6 into the non-volatile memory 28 as the data Xi, and reads out all the stored data X1, . . . , Xi from the non-volatile memory 28 (step S40 in FIG. 6). Then, the processing section 23 takes an average of all the data X1, . . . , Xi, and uses the average value as the toner cartridge related operation time Tx of the photosensitive drum 6 (step S41 in FIG. 6). In other words, the toner cartridge related operation time Tx of the photosensitive drum 6 when a quantity of remaining toner is judged low is stored for each toner cartridge 9, and an average of all toner cartridge related operation times Tx is used to find the average operation time Tx'.

Then, the processing section 23 reads out the total operation time Tt1 of the photosensitive drum 6 (step S42 in FIG. 6), and judges whether a predetermined relationship ((T1−Tt1)<0.7×Tx') is established among the average operation time Tx', total operation time Tt1, and time T1 (step S43 in FIG. 6).

Here, by the time the processing section 23 proceeds to step S35 in FIG. 6, at least two toner cartridges 9 have been used. Under these conditions, when the establishment of the predetermined relationship ((T1−Tt1)<0.7×Tx') is judged at step S43 in FIG. 6 (Yes at step S43 in FIG. 6), Condition (5) is satisfied, whereupon the processing section 23 proceeds to step S17 in FIG. 5. Consequently, a message is displayed to let the user know that the main cartridge 2*a* and the toner cartridge 9 will soon need a replacement and urge the user to prepare spare main cartridge 2*a* and toner cartridge 9. The processing section 23 maintains the state such that allows recording onto recording sheets by the image forming apparatus until the toner in the toner cartridge 9 is used up, and when the toner is used up, the processing section 23 displays an instruction to replace the main cartridge 2*a* and the toner cartridge 9, and inhibits recording onto recording sheets by the image forming apparatus.

In cases where the establishment of the predetermined relationship ((T1−Tt1)<0.7×Tx') is not judged at step S43 in FIG. 6 (No at step S43 in FIG. 6), the processing section 23 judges whether or not the recording sheets count number G has reached 60K (step S44 in FIG. 6). Incases where the recording sheets count number G is 60K or more (Yes at step S44 in FIG. 6), it is assumed that the service life of the photosensitive drum 6 is about to expire, and the processing section 23 proceeds to step S17 in FIG. 5. In cases where the recording sheets count value G is less than 60K (No at step S44 in FIG. 6), Condition (2), which is G<60K and (T1−Tt1)≧0.7×Tx', is satisfied, whereupon the processing section 23 proceeds to step S12 in FIG. 5. Consequently, the processing section 23 displays a message to let the user know that the toner cartridge 9 will soon need a replacement and urge the user to prepare a spare toner cartridge 9, and maintains the state such that allows recording onto recording sheets by the image forming apparatus until the toner in the toner cartridge 9 is used up. When the toner is used up, the processing section 23 displays an instruction to replace the toner cartridge 9 and inhibits recording onto recording sheets by the image forming apparatus.

The average operation time Tx' determined by averaging a plurality of toner cartridge related operation times Tx may be initialized each time the main cartridge 2*a* is replaced, or it may be updated each time the toner cartridge is replaced after the first use of the image forming apparatus regardless of the replacement of the main cartridge 2*a*.

Next, the following description will describe in detail, with reference to the flowchart in FIG. 7, the recording operation of the image forming apparatus at step S53 in FIG. 4 and steps S13 and S18 in FIG. 5.

The processing section 23 is in a ready state (step S61 in FIG. 7), and upon issuance of a record request onto recording sheets (step S62 in FIG. 7), the processing section 23 effects recording onto recording sheets comprehensively by controlling the image forming apparatus (step S63 in FIG. 7). At this point, in cases where the processing section 23 replenishes the developing device 8 with the toner in the toner cartridge 9 by rotating the toner replenishing roller 9*r* by means of the toner replenishing motor 9*m*, the processing section 23 forwards the toner replenishing time Ts during the replenishment (step S64 in FIG. 7).

Then, the processing section 23 sets an index N is set to 1 (N=1) (step S65*a* in FIG. 7), and then writes the toner replenishing time Ts into the IC chip 30 in the toner cartridge 9 by means of the reading/writing means 29 (step S65*b* in FIG. 7). Subsequently, the processing section 23 reads out the toner replenishing time Ts from the IC chip 30 in the toner cartridge 9 (step S65*c* in FIG. 7), and confirms a match between the read out toner replenishing time Ts and the toner replenishing time Ts stored in the non-volatile memory 28 and indicated in the control device 21 (step S65*d* in FIG. 7). In cases where there is a discrepancy between the two toner replenishing times Ts (No at step S65*d* in FIG. 7), the processing section 23 confirms that the index N is not set to 3 (N≠3) (No at step S65*f* in FIG. 7), and increments the index N by one (step S65*e* in FIG. 7), and then returns to step S65*b*. In cases where the two toner replenishing times Ts do not match with each other until index N is incremented to 3 (N=3) (Yes at step S65*f* in FIG. 7), that is, the confirmation is repeated for three times, the processing section 23 inhibits the recording operation by the image forming apparatus, and displays a message on the display screen of the display device 22 to let the use know that the toner replenishing time Ts stored in the IC chip 30 in the toner cartridge 9 is invalid (step S71 in FIG. 7).

On the other hand, the processing section 23 forwards the toner cartridge related operation time Tx while the photosensitive drum 6 is rotating in association with the recording by the image forming apparatus (step S66 in FIG. 7), and the processing section 23 writes the toner cartridge related operation time Tx into the IC chip 30 in the toner cartridge 9 by means of the reading/writing means 29 (step S67 in FIG. 7). Then, as is the case of the toner replenishing time Ts, the processing section 23 confirms a match between the toner cartridge related operation time Tx read out from the IC chip 30 in the toner cartridge 9 and the toner cartridge related operation time Tx stored in the non-volatile memory 28 and indicated in the control device 21 (step S68 in FIG. 7). In cases where a match is not judged by repeating the confirming operation up to three times (No at step S68 in FIG. 7), the processing section 23 inhibits recording operation by the image forming apparatus and displays a message on the display screen of the display device 22 to let the user know that the toner cartridge related operation time Tx stored in the IC chip 30 in the toner cartridge 9 is invalid (step S70 in FIG. 7). In cases where a match between the two toner cartridge related operation times Tx is confirmed (Yes at step S68 in FIG. 7), the processing section 23 returns to a ready state (step S69 in FIG. 7).

The foregoing recording operation of the image forming apparatus performed at step S53 in FIG. 4 and steps S13 and S18 in FIG. 5 can also be performed any other time. For example, the recording operation detailed by the flowchart in FIG. 7 can be performed while steps S7 and S8 in FIG. 4 or steps S38 and S39 in FIG. 6 are repeated.

As has been discussed, in this embodiment, whether or not any of Conditions (1) through (5) is satisfied is judged with reference to the recording sheets count value G, total operation time Tt1, the toner cartridge related operation time Tx, and the toner replenishing time Ts, and in cases where any one of Conditions (1) through (5) is satisfied, a message is displayed to urge the user to replace the process cartridge 2 or the toner cartridge 9. When the toner is used up, the recording operation is inhibited, and an instruction to replace either the process cartridge 2 or the toner cartridge 9 is displayed. Consequently, it is possible to replace the photosensitive drum 6 and the toner cartridge 9 at their respective adequate replacement timings, thereby eliminating a waste.

It should be appreciated that the present invention is not limited to this embodiment, and can be modified in various manners. For example, an IC chip may be provided to the main cartridge 2*a,* so that the recording sheets count value G and total operation time Tt1 are read out from or written into this IC chip.

Alternatively, the main cartridge 2*a* and the IC chip 30 in the toner cartridge 9 may be assigned with an ID code of their respective cartridges for use in managing the cartridges.

Further, values to be compared with the recording sheets count value G, total operation time Tt1, toner cartridge related operation time Tx, and toner replenishing time Ts can be changed in accordance with the performance and characteristics of the image forming apparatus as desired.

Also, the main cartridge should accommodate at least a photosensitive drum, and other devices, such as a developing device, a charging device, an erasing device and a cleaner, may be incorporated selectively. Likewise, the toner cartridge should at least to be filled with toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed:

1. An image forming apparatus comprising:

a process cartridge detachably mounted thereto, including a main cartridge accommodating a photosensitive body and a toner cartridge for replenishing toner;

recording sheets counting means for counting a number of recording sheets having undergone a recording operation during a service period of the main cartridge;

total operation time measuring means for measuring an operation time of the photosensitive body during the service period of the main cartridge as a total operation time;

toner cartridge related operation time measuring means for measuring an operation time of the photosensitive body during a service period of the toner cartridge as a toner cartridge related operation time;

toner replenishing time measuring means for measuring a time of replenishing toner from the toner cartridge as a toner replenishing time; and judging means for judging, based on the number of recording sheets counted by the recording sheets counting means, the total operation time measured by the total operation time measuring means, toner cartridge related operation time measured by the toner cartridge related operation time measuring means, and toner replenishing time measured by the toner replenishing time measuring means, at least one of (1) whether the main cartridge needs replacement, (2) whether the toner cartridge needs replacement, and (3) whether a recording operation is allowed or inhibited.

2. The image forming apparatus of claim 1, further comprising:

invalidating means for invalidating, in cases where the toner cartridge is replaced with another toner cartridge though the toner cartridge is still able to replenish the toner, the toner cartridge related operation time measured by the toner cartridge related operation time measuring means and the toner replenishing time measured by the toner replenishing time measuring means.

3. The image forming apparatus of claim 1, further comprising:

displaying means for displaying various kinds of information; and toner detecting means for detecting the toner cartridge has become empty, wherein the judging means displays on the displaying means: (1) a message indicating a decrease of the toner when the toner replenishing time measured by the toner replenishing time measuring means has reached a predetermined time; (2) a message indicating that the toner cartridge will soon need replacement, upon judging that the toner cartridge needs replacement, and (3) a message indicating replacement of the toner cartridge when the toner detecting means detects the toner cartridge has become empty.

4. The image forming apparatus of claim 1, wherein the toner cartridge related operation time measuring means measures the toner cartridge related operation time of the photosensitive body for a service period in each replacement of toner cartridge, and in replacement of toner cartridge, judging means takes an average of toner cartridge related operation times for all of replaced toner cartridges, and uses the average time as a toner cartridge related operation time.

5. The image forming apparatus of claim 4, wherein the judging means initializes the toner cartridge related operation time when the main cartridge is replaced.

6. The image forming apparatus of claim 4, wherein the judging means updates the average time to be used as a toner cartridge related operation time each time the toner cartridge is replaced since the image forming apparatus was activated for a first time.

7. The image forming apparatus of claim 1, further comprising:

displaying means for displaying various kinds of information; and toner detecting means for detecting the toner cartridge has become empty, wherein the judging means, upon detecting by the toner detecting means the toner cartridge has become empty, inhibits the recording operation and displays on the displaying means a message indicating replacement of the toner cartridge until the toner cartridge is replaced with another toner cartridge, regardless of a reset operation of the image forming apparatus.

8. The image forming apparatus of claim 1, further comprising:

displaying means for displaying various kinds of information; and toner detecting means for detecting the toner cartridge has become empty, wherein the judging means displays on the displaying means: (1) a message indicating a decrease of the toner when the toner replenishing time measured by the toner replenishing time measuring means has reached a predetermined time, and (2) a message indicating that the main cartridge will soon need replacement upon judging that the main cartridge needs replacement, while allowing a recording operation to continue until either the toner detecting means detects that the toner cartridge has become empty or the total operation time measured by the total operation time measuring means reaches a predetermined time.

9. The image forming apparatus of claim 1, further comprising:

displaying means for displaying various kinds of information; and toner detecting means for detecting the toner cartridge has become empty, wherein the judging means displays on the displaying means: (1) a message indicating a decrease of the toner when the toner replenishing time measured by the toner replenishing time measuring means has reached a predetermined time; and (2) a message indicating that the main cartridge will soon need replacement based on a using condition in accordance with the number of replaced toner cartridges, while allowing a recording operation to continue until the time either the toner detecting means detects the toner cartridge has become empty or the total operation time measured by the total operation time measuring means has reached a predetermined time.

10. The image forming apparatus of claim 1, further comprising:

displaying means for displaying various kinds of information, wherein the judging means inhibits a recording operation and displays on the displaying means a message indicating replacement of the main cartridge and the toner cartridge until the main cartridge and the toner cartridge are mounted regardless of a reset operation of the image forming apparatus.

11. An image forming apparatus comprising:

a process cartridge detachably mounted thereto, including a main cartridge accommodating a photosensitive body and a toner cartridge for replenishing toner;

recording sheets counting means for counting a number of recording sheets having undergone a recording operation during a service period of the main cartridge;

toner remaining quantity detecting means for detecting a quantity of remaining toner inside the toner cartridge; and judging means for judging whether the main cartridge needs replacement based on the number of recording sheets counted by the recording sheets counting means and a quantity of the remaining toner detected by the toner remaining quantity detecting means.

12. An image forming apparatus comprising:

a process cartridge detachably mounted thereto, including a main cartridge accommodating a photosensitive body and a toner cartridge for replenishing toner;

total operation time measuring means for measuring a time during which the photosensitive body operates within a service period of the main cartridge as a total operation time;

toner remaining quantity detecting means for detecting a quantity of remaining toner inside the toner cartridge; and judging means for judging whether the main cartridge needs replacement based on the total operation time measured by the total operation time measuring means and a quantity of the remaining toner detected by the toner remaining quantity detecting means.

13. An image forming apparatus comprising:

a process cartridge detachably mounted thereto, including a main cartridge accommodating a photosensitive body and a toner cartridge for replenishing toner;

total operation time measuring means for measuring a time during which the photosensitive body operates within a service period of the main cartridge as a total operation time;

toner cartridge related operation time measuring means for measuring a time during which the photosensitive body operates within a service period of the toner cartridge as a toner cartridge related operation time;

toner remaining quantity detecting means for detecting a quantity of remaining toner inside the toner cartridge; and judging means for judging whether the main cartridge needs replacement based on the total operation time measured by the total operation time measuring means, the toner cartridge related operation time measured by the toner cartridge related operation time measuring means, and a quantity of the remaining toner detected by the toner remaining quantity detecting means.

* * * * *